US005081099A

United States Patent [19]

Akutsu et al.

[11] Patent Number: 5,081,099

[45] Date of Patent: Jan. 14, 1992

[54] HEAT-SENSITIVE RECORDING MATERIAL

[75] Inventors: Mitsuo Akutsu; Syuji Iwakura; Keiji Oya, all of Urawa, Japan

[73] Assignee: Adeka Argus Chemical Co., Ltd., Tokyo, Japan

[21] Appl. No.: 554,408

[22] Filed: Jul. 19, 1990

[30] Foreign Application Priority Data

Jul. 19, 1989 [JP] Japan ..... 1-187149

[51] Int. Cl.[5] ..... B41M 5/30

[52] U.S. Cl. ..... 503/209; 503/208; 503/225

[58] Field of Search ..... 427/150–152; 503/208, 207, 225

[56] References Cited

U.S. PATENT DOCUMENTS 4,191,690 3/1980 Burri ..... 503/220

*Primary Examiner*—Pamela R. Schwartz

*Attorney, Agent, or Firm*—Young & Thompson

[57] ABSTRACT

A heat-sensitive recording material wherein a color-forming layer comprising a coupling substance which is usually colorless or light-colored and a developer which gives rise to color in the coupling substance upon heating further contains, as a sensitizer, a tetrahydronaphthalene compound of the following general formula (I):

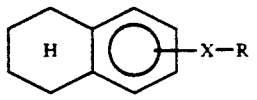

(I)

wherein X represents an alkylene group, —O—CO—O—, —O—CO— or —O—$R'_nY$—, n represents 1 or 2, Y represents —O— or —S—, R' represents an alkylene group, and R represents a phenyl, alkylphenyl or tetrahydronaphthyl group.

9 Claims, No Drawings

HEAT-SENSITIVE RECORDING MATERIAL

BACKGROUND OF THE INVENTION

1. Field of the Invention

The present invention relates to a heat-sensitive recording material. In particular, the present invention relates to a heat-sensitive recording material characterized by containing a tetrahydronaphthalene compound as sensitizer.

2. Description of the Prior Art

Heat-sensitive recording materials consist of a heat-sensitive color-forming layer comprising a dispersion of a sensitizer, binder and other additives in a coupling system comprising a usually colorless or light-colored coupling substance such as a leuco dye and a developer which causes coloring of the coupling substance upon heating, said layer being formed on a support such as paper, synthetic paper or resin film. When a heating element such as a thermal head or hot pen is brought into contact with the recording material in a recording device, the dye is reacted with the developer to develop a color such as black to thereby form a record.

The heat-sensitive recording materials are widely used in instrumental recorders, computers, facsimiles, telex devices, automatic passenger ticket vending machines, etc., since they are superior to other recording materials in that the records can be obtained in a short time, the noise is only slight and they are inexpensive.

As the colorless or light-colored coupling substances, for example, leuco dyes having a lactone, lactam or spiropyran ring are used. As the developers, various acidic substances have been proposed heretofore. Among them, phenolic compounds such as bisphenol A and benzyl p-hydroxybenzoate are frequently used either alone or in combination of them. However, when these phenols are used, increase of the recording speed and density is difficult, color shading is caused or discoloration occurs during the storage disadvantageously.

Attempts have been made to add a sensitizer to a coupling substance and a developer to thereby increase the sensitivity. The sensitizers which have been used include waxes, stearamide, and terphenyl.

However, these sensitizers are practically unsatisfactory, since they have defects that the effects of them cannot be sufficiently exerted unless they are used in a large amount, that a high sensitization of the heat-sensitive recording material required thereof cannot be sufficiently satisfied and that fogging takes place or discoloration occurs during the storage.

Under these circumstances, Japanese Patent Laid-Open No. 64593/1982 proposes the use of $\beta$-naphthyl benzoate, Japanese Patent Publication No. 25674/1984 proposes the use of substituted biphenylalkanes such as 1,2-bis(2,4-dimethylphenyl)ethane, Japanese Patent Laid-Open No. 56588/1985 proposes the use of diaryloxyalkanes such as bis(naphthyloxy)alkanes, and Japanese Patent Laid-Open No. 178087/1985 proposes the use of diaryl carbonates such as naphthyl phenyl carbonate.

However, although the coloration sensitibity is improved to some extent by using such a compound, the colored image area is discolored (disappearance of color) or the non-image area gives rise to color (fogging) disadvantageously. Another defect is that the color density of the print produced by using a heat-sensitive recording material comprising such a sensitizer after it has been stored for a long period of time is far lower than that of the print produced by using the same heat-sensitive recording material before storage.

SUMMARY OF THE INVENTION

After intensive investigations made for the purpose of overcoming these defects, the inventors have found that when a tetrahydronaphthalene compound having a specified structure is used as the sensitizer, not only an excellent coloration sensitivity is obtained but also the disappearance of color in the colored image area or the fogging of the non-image area is only very slight and the coloration sensitivity is not reduced even after the heat-sensitive recording material is stored for a long period of time. The present invention has been completed on the basis of this finding.

Thus the present invention provides a heat-sensitive recording material comprising a support and a color-forming layer, provided thereon, containing a coupling substance which is usually colorless or light-colored and a developer which gives rise to color in the coupling substance upon heating, characterized in that the color-forming layer contains a tetrahydronaphthalene compound of the following general formula (I):

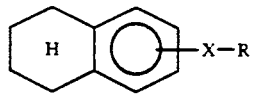

(I)

wherein X represents an alkylene group, —O—CO—O—, —O—CO— or —O—R′)$_n$Y—, n represents 1 or 2, Y represents —O— or —S—, R′ represents an alkylene group, and R represents a phenyl, alkylphenyl or tetrahydronaphthyl group.

DETAILED DESCRIPTION OF THE INVENTION

The tetrahydronaphthalene compounds of the above general formula (I) used in the present invention include 1,2-bis(5,6,7,8-tetrahydro-1-naphthoxy)ethane, 1,2-bis(5,6,7,8-tetrahydro-2-naphthoxy)ethane, 2-(2-phenoxyethoxy)-5,6,7,8-tetrahydronaphthalene, 2-[2-(3-methylphenoxy)ethoxy]-5,6,7,8-tetrahydronaphthalene, 1,5-bis(5,6,7,8-tetrahydro-2-naphthoxy)-3-oxapentane, 2-(2-phenylthioethoxy)-5,6,7,8-tetrahydronaphthalene, bis(5,6,7,8-tetrahydro-2-naphthyl)carbonate, 2-phenoxycarbonyloxy-5,6,7,8-tetrahydronaphthalene, 5,6,7,8-tetrahydro-2-naphthyl benzoate, 1,2-bis(5,6,7,8-tetrahydro-1-naphthyl)ethane and 1,2-bis(5,6,7,8-tetrahydro-2-naphthyl)ethane.

The tetrahydronaphthalene compounds used in the present invention can be easily produced by the known esterification or etherification reaction of tetrahydronaphthol or by the reaction of tetrahydronaphthalene with a dihaloalkane.

Synthesis Examples for the tetrahydronaphthalene compounds used in the present invention will now be described.

SYNTHESIS EXAMPLE 1

Synthesis of
2-[2-(3-methylphenoxy)ethoxy]-5,6,7,8-tetrahydronaphthalene

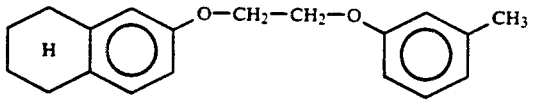

4.0 g (0.06 mol) of 85% potassium hydroxide was dissolved in 25 g of distilled water and 7.4 g (0.05 mol) of 5,6,7,8-tetrahydro-β-naphthol was dissolved in the formed solution. 8.5 g (0.05 mol) of 2-(3-methylphenoxy)ethyl chloride was added to the solution and the mixture was stirred under reflux for 3 h.

The reaction mixture was cooled to form crystals, which were recovered by filtration and recrystallized from 50 ml of ethanol to give 11.2 g (yield: 79%) of the intended product in the form of a white powder having a melting point of 73° C.

Results of infrared spectral analysis: νc=c: 1600, 1500 $cm^{-1}$. νc—O: 1258, 1240, 1000 $cm^{-1}$. νc—H: 2940, 2850, 1455, 1380, 790 $cm^{-1}$.

The following compounds were synthesized in the same manner as that of Synthesis Example 1:

2-(2-phenoxyethoxy)-5,6,7,8-tetrahydronaphthalene (m.p.: 106° C.)

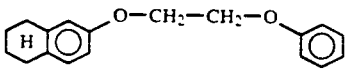

1,2-bis (5,6,7,8-tetrahydro-2-naphthoxy)ethane (m.p.: 111° C.)

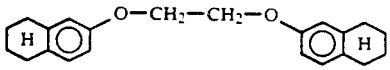

1,5-bis (5,6,7,8-tetrahydro-2-naphthoxy)-3-oxapentane (m.p.: 75° C.)

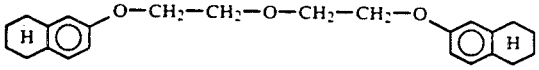

SYNTHESIS EXAMPLE 2

Synthesis of
2-(phenoxycarbonyloxy)-5,6,7,8-tetrahydronaphthalene

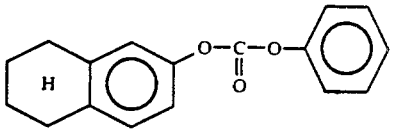

9.4 g (0.06 mol) of phenyl chloroformate and 9.3 g (0.063 mol) of 5,6,7,8-tetrahydro-β-naphthol were dissolved in 50 ml of toluene and 7.1 g of triethylamine was added dropwise to the solution at room temperature over 30 min.

After the completion of the addition followed by stirring at 60° C. for additional 1 h, triethylamine hydrochloride thus formed was removed and the solvent was distilled off.

The residue was recrystallized from ethanol to give 12.9 g (yield: 80%) of the intended product in the form of a white powder having a melting point of 77° C.

5,6,7,8-Tetrahydro-2-naphthyl benzoate in the form of a white powder having a melting point of 98° C. was obtained in the same manner as that of Synthesis Example 2:

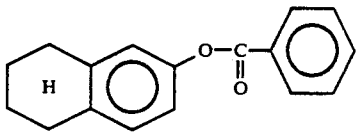

SYNTHESIS EXAMPLE 3

Synthesis of
bis(5,6,7,8-tetrahydro-2-naphthyl)carbonate

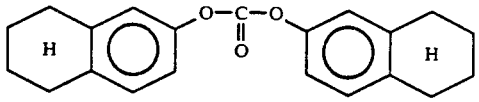

17.1 g (0.08 mol) of diphenyl carbonate, 59.3 g (0.40 mol) of 5,6,7,8-tetrahydro-β-naphthol and 0.15 g of potassium carbonate were stirred together at 100° C. for 1 h.

After stirring at 120° C. under a reduced pressure of 15 mmHg for 2 h while distilling off phenol thus formed, unreacted starting materials were distilled off at 160° C./3 mmHg.

After cooling, 100 ml of toluene was added thereto. After washing with water, drying and removal of the solvent, the residue was recrystallized from ethanol to give 10.2 g (yield: 79%) of the intended product in the form of a white powder having a melting point of 112° C.

Results of infrared spectral analysis: νc=O: 1760, 1240 $cm^{-1}$. νc—H: 2950, 2900, 1620, 1590, 1500 $cm^{-1}$.

SYNTHESIS EXAMPLE 4

Synthesis of
2-(2-phenylthioethoxy)-5,6,7,8-tetrahydronaphthalene

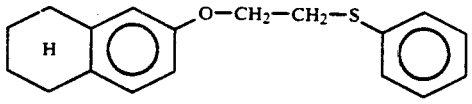

5.1 g (0.033 mol) of 2-phenylthioethanol, 3.7 g (0.025 mol) of 5,6,7,8-tetrahydro-β-naphthol and 7.9 g (0.03 mol) of triphenylphosphine were dissolved in 60 g of diethyl ether and a solution of 5.2 g (0.03 mol) of diethyl azodicarboxylate in diethyl ether was added dropwise to the solution at room temperature.

After the reaction mixture was stirred under reflux for 3 h, triphenylphosphine oxide thus formed was removed by filtration and the solvent was removed from the filtrate. The residue was recrystallized from ethanol to give 4.3 g (yield: 61%) of the intended product in the form of a white powder having a melting point of 40° C.

Results of infrared spectral analysis: νc=c: 1610, 1590, 1500, 1320, 740 $cm^{-1}$. νc—O: 1250, 1230, 1010 $cm^{-1}$. νc—H: 2940, 2850, 1320, 740 $cm^{-1}$.

SYNTHESIS EXAMPLE 5

Synthesis of 1,2-bis(5,6,7,8-tetrahydro-2-naphthyl)ethane

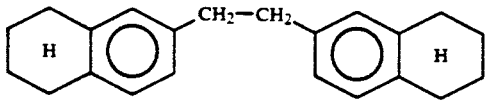

5.0 g (0.05 mol) of 1,2-dichloroethane and 13.3 g (0.1 mol) of aluminum chloride were added to 66.1 g (0.50 mol) of 5,6,7,8-tetrahydronaphthalene and the formed mixture was stirred at room temperature for 1 h. 6N hydrochloric acid was added thereto and the product was extracted with 500 ml of diethyl ether.

After washing with water, drying and removal of the solvent, excess 5,6,7,8-tetrahydronaphthalene was distilled off at 200° C./5 mmHg.

After recrystallization from n-hexane, 4.2 g (yield: 29%) of the intended compound was obtained in the form of a white powder having a melting point of 97° C.

Results of infrared spectral analysis: νc=c: 1905, 1780, 1760, 1620, 1580, 1500 $cm^{-1}$. νc—H: 2950, 2880, 840, 820 $cm^{-1}$.

$^1$H-NMR (60 MHz, $CDCl_3$) 1.5~2.2: 8H, m 2.5~3.1: 12H, m 6.8~7.2: 6H, brs.

Various dyes are known as the usually colorless or light-colored coupling substances. The coupling substances used in the present invention are not particularly limited so far as they are usually used for producing ordinary pressure-sensitive recording papers or heat-sensitive recording papers.

Examples of the coupling substances usable in the present invention include (1) triarylmethane compounds such as 3,3-bis(p-dimethylaminophenyl)-6-dimethylaminophthalide (Crystal Violet Lactone), 3-(p-dimethylaminophenyl)-3-(1,2-dimethyl-3-indolyl)phthanlide, 3-(p-dimethylaminophenyl)-3-(2-phenyl-3-indolyl)phthalide, 3,3-bis(9-ethyl-3-carbazolyl)-5-dimethylaminophthalide and 3,3-bis(2-phenyl-3-indolyl)-5-dimethylaminophthalide;

(2) diphenylmethane compounds such as 4,4-bis(-dimethylamino)benzhydrin benzyl ether and N-2,4,5-trichlorophenylleucoauramine;

(3) xanthene compounds such as Rhodamine-β-anilinolactam, 3-dimethylamino-7-methoxyfluoran, 3-dimethylamino-6-methoxyfluoran, 3-diethylamino-7-methoxyfluoran, 3-dimethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-6-methyl-7-xylidinofluoran, 3-diethylamino-7-N-chloroethyl-N-methylaminofluoran, 3-diethylamino-7-N-diethylaminofluoran, 3-(N-ethyl-p-toluidino)-6-methyl-7-(p-toluidino)fluoran, 3-diethylamino-7-octylaminofluoran, 3-diethylamino-7-(2-chloroanilino)fluoran, 3-diethylamino-6-methyl-7-anilinofluoran, 3-diethylamino-6-chloro-7-(β-ethoxyethylamino)fluoran, 3-diethylamino-7-(2-carbomethoxyphenylamino)fluoran, 3-(N-ethyl-N-isoamylamino)-6-methyl-7-anilinofluoran, 3-(N-methyl-N-n-amylamino)-6-methyl-7-anilinofluoran, 3-(N-ethyl-N-n-amylamino)-6-methyl-7-anilinofluoran, 3-(N-methyl-N-n-hexylamino)-6-methyl-7-anilinofluoran, 3-(N-ethyl-N-n-hexylamino)-6-methyl-7-anilinofluoran, 3-(N-ethyl-N-β-ethylhexylamino)-6-methyl-7-anilinofluoran, 3-dibutylamino-6-methyl-7-anilinofluoran, 3-dibutylamino-7-(2-chloroanilino)fluoran, 3-piperidino-6-methyl-7-anilinofluoran, 3-(N-ethyl-p-toluidino)-6-methyl-7-anilinofluoran, 3-pyrrolidino-6-methyl-7-anilinofluoran, 3-pyrrolidino-6-methyl-7-p-butylphenylaminofluoran, 3-(N-cyclohexyl-N-methylamino)-6-methyl-7-anilinofluoran, 3-(N-isopropyl-N-ethylamino)-6-methyl-7-anilinofluoran and 3-diethylamino-6-chloro-7-γ-chloropropylaminofluoran;

(4) thiazine compounds such as benzoyl leuco methylene blue and p-nitrobenzoyl leuco methylene blue; and (5) spiro compounds such as 3-methylspirodinaphthopyran, 3-ethylspirodinaphthopyran, 3-benzylspirodinaphthopyran and 3-methylnaphtho(3-methoxybenzo)spiropyran.

These coupling substances (dyes) can be used either singly or in the form of a mixture of two or more of them.

The developers usable in the present invention include, for example, phenols such as p-octylphenol, p-tert-butylphenol, p-phenylphenol, p-hydroxyacetophnone, α-naphthol, β-naphthol, p-tert-octylcatechol, 2,2'-dihydroxybiphenyl, bisphenol A, 1,1-bis(p-hydroxyphenyl)butane, 2,2-bis(4-hydroxyphenyl)heptane, 2,2-bis(3-methyl-4-hydroxyphenyl)propane, 2,2-bis(3,5-dimethyl-4-hydroxyphenyl)propane, 2,2-bis(3,5-dichloro-4-hydroxyphenyl)propane, bis(4-hydroxyphenyl)sulfone, bis(3,4-dihydroxyphenyl)sulfone bis(4-allyl-4-hydroxyphenyl)sulfone, 4-hydroxy-4'-isopropoxydiphenyl sulfone, 1,1-bis(4-hydroxyphenyl)cyclohexane, bis(4-hydroxyphenyl)ether, p-hydroxybenzoic acid, ethyl p-hydroxybenzoate, butyl p-hydroxybenzoate, benzyl p-hydroxybenzoate, butyl bis(4-hydroxyphenyl)acetate, 1,1,3-tris(2-methyl-4-hydroxy-5-tert-butylphenyl)butane, 1,1,3-tris(2-methyl-4-hydroxy-5-cyclohexylphenyl)butane, bis[2-(4-hydroxyphenylthio)ethoxy]methane and dimethyl 4-hydroxyphthalate; aliphatic carboxylic acids such as oxalic, maleic, tartaric, citric, succinic, stearic and behenic acids; aromatic carboxylic acids such as benzoic, tert-butylbenzoic, phthalic, gallic, salicylic, isopropylsalicylic, phenylsalicylic, 3,5-di-tert-butylsalicylic, 3-methyl-5-benzylsalicylic, 3,5-di(α-methylbenzyl)salicylic and 3-phenyl-5-(α,α-dimethylbenzyl)salicylic acids and polyvalent metal salts of these aromatic carboxylic acids, such as zinc, magnesium, aluminum, calcium, titanium, manganese, tin and nickel salts of them; and inorganic developers such as acid clay, activated clay, attapulgite, bentonite, colloidal silica, aluminum silicate, magnesium silicate, zinc silicate, tin silicate, calcined kaolin and talc.

The tetrahydronaphthalene compound of the above general formula (I), the coupling substance and the developer to be used in the present invention are finely ground with a grinding machine such as a ball mill, atomizer or sand grinder or a suitable emulsifier and, if necessary, additives are added thereto to form a coating fluid.

The coating fluid usually contains a binder such as polyvinyl alcohol, hydroxyethylcellulose, methylcellulose, polyacrylamide, starch, styrene/maleic anhydride copolymer, vinyl acetate/maleic anhydride copolymer, styrene/butadiene copolymer or modifications of them, and a filler such as silane, kaolin, diatomaceous earth, talc, titanium dioxide, calcium carbonate, magnesium carbonate, aluminum hydroxide or melamine. Further metallic soaps, amides, waxes, light stabilizers, preservatives, waterproofing agents, dispersants and antifoaming agents can also be used.

The coating fluid is applied to a support such as paper, synthetic paper or film such as resin film to form the intended heat-sensitive recording material.

The amount of the tetrahydronaphthalene compound of the above general formula (I) used in the present invention is not particularly limited, since it varies depending on the necessitated properties, suitability for the recording, and kinds and amounts of other additives used. However, it is usually 0.1 to 10 parts by weight per part by weight of the coupling substance.

Preferred proportions of the components constituting the color-forming layer of the heat-sensitive recording material of the present invention are as follows: 3 to 30% by weight of the coupling substance (leuco dye), 3 to 40% by weight of the developer, 3 to 40% by weight of the tetrahydronaphthalene compound of the above general formula (I) (sensitizer) and the balance of the binder (resin component), filler, lubricant, etc.

The following examples will further illustrate the present invention.

EXAMPLE 1

20 g of 3-(N,N-diethylamino)-6-methyl-7-anilinofluoran and 100 g of a 10% aqueous polyvinyl alcohol solution were sufficiently milled to give a dye dispersion (dispersion A).

20 g of bisphenol A and 100 g of a 10% aqueous polyvinyl alcohol solution were sufficiently milled to give a developer dispersion (dispersion B).

20 g of a sample compound listed in the following Table 1 and 100 g of a 10% aqueous polyvinyl alcohol solution were sufficiently milled to give a dispersion (dispersion C).

20 g of zinc stearate and 100 g of a 10% aqueous polyvinyl alcohol solution were sufficiently milled to give a dispersion (dispersion D).

The dispersions A, B, C and D and finely pulverized silica were mixed in a weight ratio of 1:2:2:0.4:0.5 and well dispersed to give a homogenous coating fluid.

The coating fluid was applied to a paper support (basis weight: 50 g/m$^2$) to form a layer having a thickness of 28 $\mu$m, which was dried to give a heat-sensitive recording material.

After printing on a heat-sensitive paper thus obtained while varying the pulse width with a heat-sensitive printer (TH-PMD; mfd. by Ohkura Electric Co., Ltd.), the color density of the recorded image was determined with a Macbeth densitometer (RD-933; mfd. by Macbeth Co.). Then the colored heat-sensitive paper was kept at a relative humidity of 90% at a temperature of 60° C. for 3 h and then at 60° C. under dry condition for 3 h to examine the storability.

Then the heat-sensitive paper was kept at 60° C. under dry condition for 48 h. After printing on the paper while varying the pulse width in the same manner as that described above to evaluate the coloration sensitivity after the storage (reprintability). The results are given in Table 1.

TABLE 1

| Sample compound | Pulse width (msec) | Initial density | Density after storage Dry | Density after storage Wet heat | Reprintability |
|---|---|---|---|---|---|
| 1,2-bis(3-methylphenoxy)ethane | 0.0 | 0.07 | 0.09 | 0.11 | 0.13 |
| (Comparative example) | 0.4 | 0.46 | 0.15 | 0.17 | 0.33 |
| | 0.8 | 1.45 | 1.16 | 1.06 | 1.08 |
| 2-(2-phenoxyethoxy)naphthalene | 0.0 | 0.10 | 0.12 | 0.14 | 0.18 |
| (Comparative example) | 0.4 | 0.51 | 0.16 | 0.17 | 0.34 |
| | 0.8 | 1.37 | 1.10 | 1.02 | 0.96 |
| 2-naphthyl benzoate | 0.0 | 0.09 | 0.11 | 0.14 | 0.16 |
| (Comparative example) | 0.4 | 0.44 | 0.14 | 0.15 | 0.32 |
| | 0.8 | 1.35 | 1.04 | 0.98 | 0.93 |
| 2-(phenoxycarbonyloxy)naphthalene | 0.0 | 0.08 | 0.11 | 0.14 | 0.18 |
| (Comparative example) | 0.4 | 0.44 | 0.16 | 0.17 | 0.34 |
| | 0.8 | 1.37 | 1.07 | 1.02 | 0.95 |
| 1,2-bis(2,4-dimethylphenyl)ethane | 0.0 | 0.11 | 0.18 | 0.21 | 0.22 |
| (Comparative example) | 0.4 | 0.59 | 0.42 | 0.40 | 0.46 |
| | 0.8 | 1.15 | 0.98 | 0.93 | 0.91 |
| 2-{2-(3-methylphenoxy)ethoxy}- | 0.0 | 0.07 | 0.08 | 0.08 | 0.10 |
| 5,6,7,8-tetrahydronaphthalene | 0.4 | 0.65 | 0.50 | 0.55 | 0.62 |
| (Present invention) | 0.8 | 1.45 | 1.30 | 1.24 | 1.40 |
| 2-(2-phenoxyethoxy)-5,6,7,8-tetra | 0.0 | 0.06 | 0.07 | 0.08 | 0.09 |
| hydronaphthalene | 0.4 | 0.63 | 0.51 | 0.54 | 0.64 |
| (Present invention) | 0.8 | 1.45 | 1.32 | 1.27 | 1.45 |
| 1,2-bis(5,6,7,8-tetrahydro-2- | 0.0 | 0.07 | 0.07 | 0.08 | 0.09 |
| naphthoxy)ethane | 0.4 | 0.44 | 0.37 | 0.38 | 0.44 |
| (Present invention) | 0.8 | 1.50 | 1.34 | 1.28 | 1.47 |
| 1,5-bis(5,6,7,8-tetrahydro-2- | 0.0 | 0.07 | 0.08 | 0.09 | 0.09 |
| naphthoxy)-3-oxapentane | 0.4 | 0.46 | 0.36 | 0.35 | 0.44 |
| (Present invention) | 0.8 | 1.45 | 1.30 | 1.22 | 1.41 |
| 2-(phenoxycarbonyloxy)-5,6,7,8- | 0.0 | 0.07 | 0.09 | 0.10 | 0.10 |
| tetrahydronaphthalene | 0.4 | 0.48 | 0.39 | 0.37 | 0.42 |
| (Present invention) | 0.8 | 1.42 | 1.26 | 1.22 | 1.38 |
| 5,6,7,8-tetrahydro-2-naphthyl | 0.0 | 0.07 | 0.10 | 0.09 | 0.10 |
| benzoate | 0.4 | 0.35 | 0.28 | 0.27 | 0.33 |
| (Present invention) | 0.8 | 1.35 | 1.19 | 1.15 | 1.30 |
| bis(5,6,7,8-tetrahydro-2-naphthyl) | 0.0 | 0.07 | 0.08 | 0.09 | 0.09 |
| carbonate | 0.4 | 0.46 | 0.41 | 0.39 | 0.43 |
| (Present invention) | 0.8 | 1.48 | 1.30 | 1.27 | 1.42 |
| 1,2-bis(5,6,7,8-tetrahydro-2- | 0.0 | 0.08 | 0.09 | 0.10 | 0.10 |
| naphthyl)ethane | 0.4 | 0.58 | 0.57 | 0.56 | 0.58 |

TABLE 1-continued

| Sample compound | Pulse width (msec) | Initial density | Density after storage Dry | Wet heat | Reprintability |
|---|---|---|---|---|---|
| (Present invention) | 0.8 | 1.37 | 1.33 | 1.31 | 1.35 |

It is apparent from the results given in Table 1 that the sensitizers used heretofore are practically unsatisfactory, since they have a poor storability and a very poor reprintability, though some of them have a relatively good sensitivity.

On the contrary, the heat-sensitive recording material of the present invention containing the tetrahydronaphthalene compound of the above general formula (I) has not only an excellent coloration sensitivity but also excellent storability and quite excellent reprintability. The coloration sensitivity is scarcely reduced even after storage under severe conditions for a long time.

What is claimed is:

1. A heat-sensitive recording material comprising a support and a color-forming layer, provided thereon, containing a coupling substance which is usually colorless or light-colored and a developer which gives rise to color in the coupling substance upon heating, characterized in that the color-forming layer contains a tetrahydronaphthalene compound of the following general formula (I):

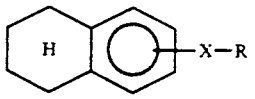

(I)

wherein X represents an alkylene group, —O—CO—O—, —O—CO— or —O—R')$_n$Y—, n represents 1 or 2, Y represents —O— or —S—, R' represents an alkylene group, and R represents a phenyl, alkylphenyl or tetrahydronaphthyl group.

2. A heat-sensitive recording material according to claim 1, wherein a compound of the general formula (I) in which R represents a phenyl group is used.

3. A heat-sensitive recording material according to claim 1, wherein a compound of the general formula (I) in which R represents a methylphenyl group is used.

4. A heat-sensitive recording material according to claim 1, wherein a compound of the general formula (I) in which R represents a tetrahydronaphthyl group is used.

5. A heat-sensitive recording material according to claim 1, wherein a compound of the general formula (I) in which X represents —$CH_2CH_2$— is used.

6. A heat-sensitive recording material according to claim 1, wherein a compound of the general formula (I) in which X represents —O—$CH_2CH_2$—O— is used.

7. A heat-sensitive recording material according to claim 1, wherein a compound of the general formula (I) in which X represents —O—CO—O— is used.

8. A heat-sensitive recording material according to claim 1, wherein a compound of the general formula (I) in which X represents —O—CO— is used.

9. A heat-sensitive recording material according to claim 1, wherein the amount of the tetrahydronaphthalene compound of the general formula (I) is 0.1 to 10 parts by weight per part by weight of the coupling substance.

* * * * *